United States Patent [19]

Kim

[11] Patent Number: 4,693,019

[45] Date of Patent: Sep. 15, 1987

[54] SPORTS SHOE PROTECTOR

[76] Inventor: Sun K. Kim, 2381 E. 6780 South, Salt Lake City, Utah 84121

[21] Appl. No.: 835,345

[22] Filed: Mar. 3, 1986

[51] Int. Cl.[4] ..... A43B 1/10; A43B 5/00

[52] U.S. Cl. ..... 36/7.3; 36/135; 36/7.1 R

[58] Field of Search ..... 36/7.1 R, 7.1 A, 7.3, 36/7.5, 7.6, 127, 135, 72 R

[56] References Cited

U.S. PATENT DOCUMENTS

| | | | |
|---|---|---|---|
| 1,811,781 | 6/1931 | Degge | 36/7.5 |
| 1,958,107 | 5/1934 | Merrill et al. | 36/135 |
| 2,032,052 | 2/1936 | Friedenberg | 36/7.3 |
| 2,076,316 | 4/1937 | Beals, Jr. | 36/7.5 |
| 2,958,963 | 11/1960 | Lougheed | 36/7.5 |
| 3,176,416 | 4/1965 | Seegert | 36/7.1 R |
| 3,283,424 | 11/1966 | Struntz | 36/7.5 |
| 3,559,310 | 2/1971 | Kiela | 36/7.3 |
| 3,566,488 | 3/1971 | Pilarski | 36/7.5 |
| 3,812,603 | 5/1974 | Goodman | 36/7.5 |
| 3,821,858 | 7/1974 | Haselden | 36/2.5 |
| 3,858,336 | 1/1975 | Brown | 36/2.5 |
| 3,913,243 | 10/1975 | Arnold et al. | 36/2.5 |
| 4,055,005 | 10/1977 | Meinhart | 36/135 |
| 4,258,483 | 3/1981 | Hogue | 36/135 |
| 4,484,398 | 11/1984 | Goodwin et al. | 36/135 |

FOREIGN PATENT DOCUMENTS

| | | | |
|---|---|---|---|
| 3044032 | 6/1982 | Fed. Rep. of Germany | 36/135 |
| 3131554 | 2/1983 | Fed. Rep. of Germany | 36/135 |
| 2140273 | 11/1984 | United Kingdom | 36/135 |

*Primary Examiner*—Werner H. Schroeder
*Assistant Examiner*—Steven N. Meyers
*Attorney, Agent, or Firm*—Jon C. Christiansen

[57] ABSTRACT

This invention is a sports shoe protector having a sole and a means for securing the sole to a sports shoe having spikes. The sole includes at least one U-shaped shoulder extending from a peripheral portion of the base of the sole to provide peripheral support to the shoe and to provide an open area for receiving shoe spikes. An inner support extending from the base and positioned within the mouth of the U-shaped shoulder can be used to provide additional support and to form, in combination with the U-shaped shoulder, an open channel area for receiving shoe spikes.

6 Claims, 4 Drawing Figures

SPORTS SHOE PROTECTOR

INTRODUCTION

My invention relates to a sports shoe protector which can be used in combination with sports shoes having spikes, cleats or other traction devices protruding from the sole. Such spikes, cleats and devices are collectively referred to in this specification and the appended claims as "spikes". Such sports shoes include, by way of example, golf shoes, soccer shoes, football shoes, baseball shoes, trak (or running) shoes, etc. As used in this specification and the appended claims, "sports shoes" include other shoes and footwear having spikes even if they are not used in connection with sports. The sports shoe protector is worn over sports shoes to facilitate mobility off the field and in clubhouses, restaurants, parking lots and other areas. The sports shoe protector protects against damage to spikes and damage caused by spikes to floors, walkways and other surfaces. The sports shoe protector also protects against slipping and tripping caused by spikes. Because of these advantages, the sports shoe protector allows sportsmen great mobility without the need to remove their shoes. It is an object of this invention to achieve and provide the advantages described above. Other objects, advantages and aspects of this invention are apparent from a study of this specification and the appended claims and drawings.

SUMMARY OF THE INVENTION

My invention is a sports shoe protector having a sole and a means for connecting the sole to a sports shoe having spikes. The sole has a base and at least one U-shaped shoulder extending from the base and positioned to provide peripheral support to the shoe. An open area within the mouth of the U-shaped shoulder is available to receive spikes when the sole is secured to the shoe. The sole can further include one or more inner supports extending from the base and positioned to provide support to the shoe when the sole is secured to the shoe. The inner support is positioned at least partially within the mouth of the U-shaped shoulder. The U-shaped shoulder and the inner support form an open channel positioned to receive spikes. Two U-shaped shoulders, forward and rear, are preferred. The shoulders may be connected by bridges or may not be connected at all or may be connected directly to each other. When connected to each other the U-shaped shoulders form an oval-shaped shoulder which is within the scope of this invention and the appended claims.

DETAILED DESCRIPTION OF THE INVENTION

Figure 1:
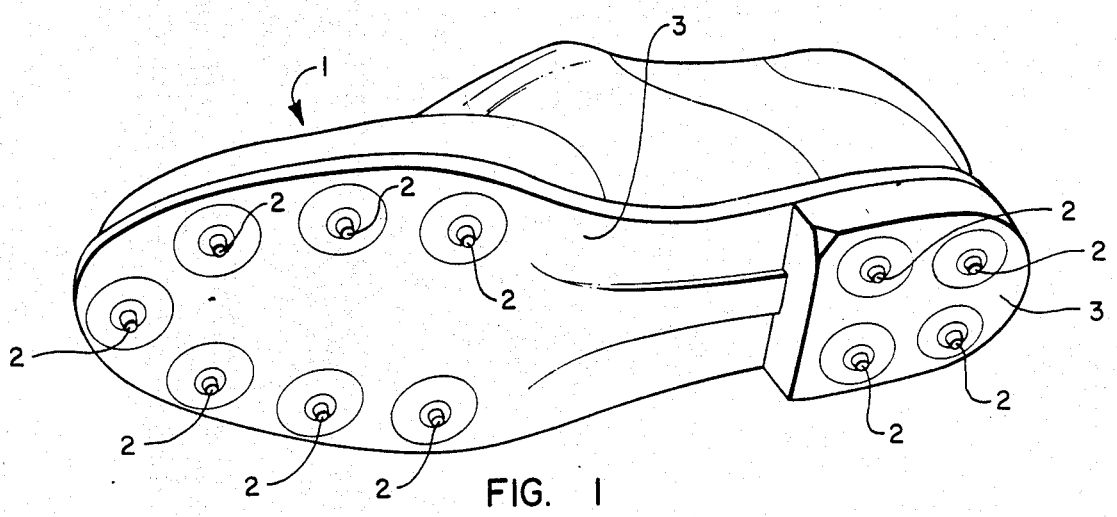
FIG. 1 depicts a sports shoe having spikes.
Figure 2:
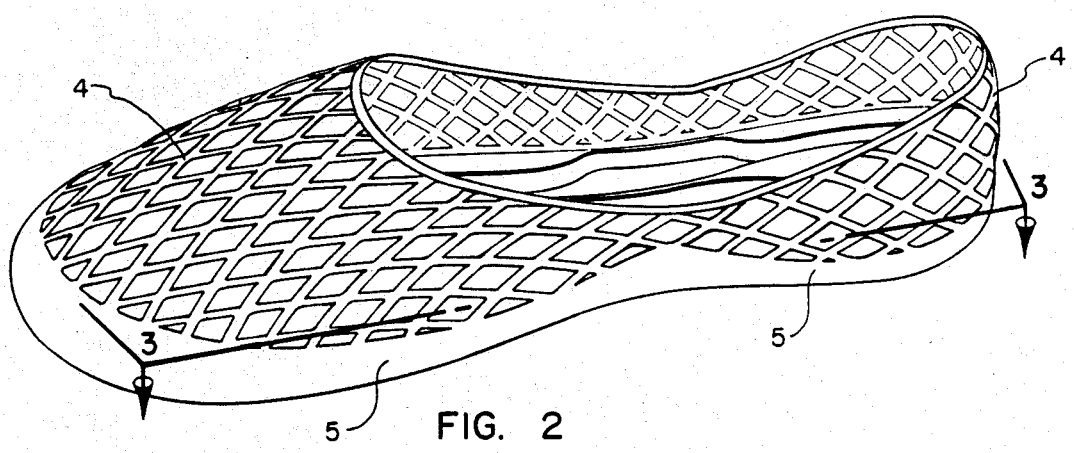
FIG. 2 depicts a perspective view of a sports shoe protector.
Figure 3:
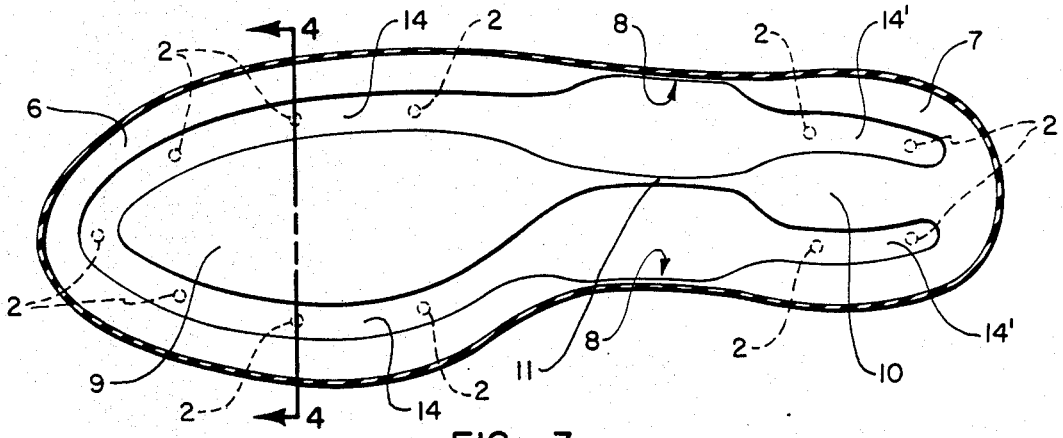
FIG. 3 depicts the sole of the sports shoe protector of FIG. 2.
Figure 4:
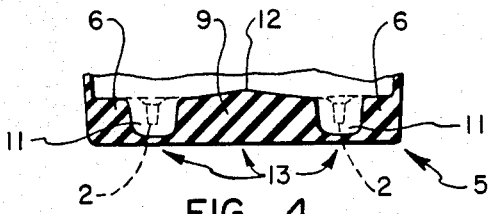
FIG. 4 depicts a cross-sectional view of the sole of FIG. 3.

FIG. 1 depicts a sports shoe 1 having spikes 2 protruding outward from shoe sole 3. (Note: for the purposes of this disclosure and the appended claims, a heel is deemed a part of a sole). FIGS. 2, 3 and 4 depict a sports shoe protector which represents the preferred embodiment of this invention.

With reference to FIG. 2, the sports shoe protector has an upper portion 4 and a lower portion or sole 5. Upper portion 4 is a flexible nylon net shaped and adapted to receive and fit around the shoe and to secure sole 5 to shoe 1. Upper portion 4 is not restricted to a nylon or net construction. Other materials such as rubber, leather, canvas, etc. can be used. It is preferred that the material be flexible to facilitate placement over and removal from the shoe. The scope of this invention is not limited to the above-described upper portion means for securing sole 5 to shoe 1, but, rather, also includes any other means for securing sole 5 to shoe 1 presently or subsequently known to persons of ordinary skill in the relevant art, including straps, laces and the like. Sole 5 is made of a flexible rubber material (or other material, e.g. nylon, leather, canvas, etc.). The bottom of sole 5 is in the shape of a conventional shoe bottom, i.e. sole and heel without spikes. Other bottom designs (e.g. completely flat surface or a spike-free traction-providing surface) can be used in the alternative if desired.

FIGS. 3 and 4 provide more detail concerning sole 5. Sole 5 has forward U-shaped shoulder 6, rear U-shaped shulder 7, bridges 8, forward inner support 9, rear inner support 10, bridge 11 and a base 13 from which 6, 7, 8, 9, 10 and 11 extend. Base 13 is substantially planar (the word "substantially" allowing for a heel and/or some other variation from a literally planar surface in a strict geometric sense). The peripheral shape of base 13 is sized and dimensioned to accomodate shoe 1. Preferably, sole 5 is of an integral construction (i.e. components 6, 7, 8, 9, 10, 11, and 13 form a unitary body). Alternatively, some or all of components 6, 7, 8, 9. 10 and 11 can be of a separate construction and secured to base 13 through use of an adhesive, stitching or other means.

Shoulder 6 is U-shaped in that it substantially conforms to the peripheral shape of the forward portin of shoe 1. Shoulder 7 is U-shaped in that it substantially conforms to the outer shape of the rear portion of shoe 1. Shoulder 6 is positioned on the forward peripheral portion of base 13. Shoulder 7 is positioned on the rear peripheral portion of base 13. Shoulders 6 and 7 provide peripheral support to shoe 1. Peripheral support means support to the outside (or peripheral) portion of the sole 3 of shoe 1. Peripheral support is deemed to be provided and the shoulder is deemed to be positioned on a forward or rear peripheral portion of the base, when all of the forward or rear spikes of the shoe are within the mouth of the U-shaped shoulder or would be if each of the arms of the U were extended in a straight line. Forward inner support 9 and rear inner support 10 provide support to the inner portion of the sole 3 of shoe 1. Support 9 is within the mouth of U-shaped shoulder 6. Support 10 is within the mouth of U-shaped shoulder 7. Shoulder 6 and support 9 form an open channel area 14 which is positioned to receive spikes 2 of the forward portion of shoe 1. Shoulder 7 and support 10 form open channel areas 14' which are positioned to receive spikes 2 of the rear portion of the shoe 1. Note that 14 and 14' form an open U-shaped channel for receiving spikes 2. Note that support 10 is connected with U-shaped shoulder 7. If shoulder 7 and support 10 were not connected, the spike-receiving channel would be oval-shaped (an oval-shaped channel is within the scope of this invention). Althugh not shown or preferred, additional support can be provided through additional support members which extend from the base at various channel positions and which run from shoulder (6 or 7) to inner support member (9 or 10); provided that additional support members do not occupy a channel position needed for reception of a spike. It should also be noted that the terms "U-shaped" and "oval-shaped" as used in this specification and the appended claims mean substantially U-shaped and substantially oval-shaped to accomodate some reasonable variation from a strict and literal geometric definition.

The support provided by shoulders 6 and 7 and supports 9 and 10 creates an open area for receiving spikes 2 and prevents damage to or by spikes 2 and in combination with base 13 prevents slipping or tripping caused by spikes 2. Shoulders 6 and 7 and supports 9 and 10 should be sufficiently high to hold spikes 2 above base 13 although some penetration by spikes 2 into (but not through) base 13 (especially if base 13 is constructed of a resilient material) is acceptable. Support 9 includes a raised portion 12 which, with reference to FIG. 3, runs from left to right across support 9. Raised portion 12 is elevated from shoulder 6. Raised portion 12 provides additional support to the shoe area carrying most of the weight and thus allows for better overall balance and support without undue reliance on shoulder 6. For the same purpose and reason, support 10 can include a raised portion (not shown).

Shoulders 6 and 7 are connected through bridges 8. Supports 9 and 10 are connected through bridge 11. The bridges are made of the same material as are shoulders 6 and 7 and supports 9 and 10 (however different materials can be used but should be stretchable). Bridges 8 are thinner than shoulders 6 and 7. Bridge 11 is thinner than supports 9 and 10. Because the bridges are thin, this facilitates stretching of sole 5 which in turn facilitates placement on and removal from shoe 1. In an alternative embodiment, bridges are not used, the shoulders 6 and 7 are not connected and supports 9 and 10 are not connected. This creates an intermediate portion of base between shoulders 6 and 7 and between shoulders 9 and 10 over which none of the shoulders or supports is positioned. This construction similarly allows for stretching of sole 5.

My invention includes variations from the subject matter descibed above which are suggested by this disclosure but which are not unpatentable over applicable prior art. The appended claims are intended to include such variations and appropriate equivalents.

What is claimed is:

1. A sports shoe protector comprising a sole and a means for securing said sole to a shoe having spikes, wherein said sole is comprised of a substantially planar base, a forward U-shaped shoulder extending from the forward peripheral portion of said base, a rear U-shaped shoulder extending from the rear peripheral portion of said base, a forward inner support extending from said base and positioned at least partially within the mouth of said forward U-shaped shoulder, and a rear inner support extending from the said base and positioned at least partially within the mouth of said rear U-shaped shoulder; wherein the peripheral shape of said base is sized and dimensioned to accommodate said shoe; wherein said forward shoulder provides peripheral support to the forward portion of said shoe when said sole is secured to said shoe; wherein said rear shoulder provides peripheral support to the rear portion of said shoe when said sole is secured to said shoe; wherein said forward inner support provides support to the forward position of said shoe when said sole is secured to said shoe; wherein said rear inner support provides support to the rear portion of said shoe when said sole is secured to said shoe; wherein said forward shoulder and said forward inner support form at least one channel area to receive the forward spikes of said spikes; wherein said rear shoulder and said rear inner support form at least one channel area to receive the rear spikes of said spikes; wherein said sole serves to protect against damage by or to said spikes; wherein said sole further comprises bridges extending from said base and connecting said forward shoulder and said rear shoulder; and wherein said bridges are substantially thinner than said shoulders.

2. A sports shoe protector comprising a sole and a means for securing said sole to a shoe having spikes; wherein said sole is comprised of a substantially planar base, a forward U-shaped shoulder extending from the forward peripheral portion of said base, a rear U-shaped shoulder extending from the rear peripheral portion of said base, a forward inner support extending from said base and positioned at least partially within the mouth of said forward U-shaped shoulder, and a rear inner support extending from the said base and positioned at least partially within the mouth of said rear U-shaped shoulder; wherein the peripheral shape of said base is sized and dimensioned to accommodate said shoe; wherein said forward shulder provides peripheral support to the forward portion of said shoe when said sole is secured to said shoe; wherein said rear shoulder provides peripheral support to the rear portion of said shoe when said sole is secured to said shoe; wherein said forward inner support provides support to the forward portion of said shoe when said sole is secured to said shoe; wherein said rear inner support provides support to the rear portion of said shoe when said sole is secured to said shoe; wherein said forward shoulder and said forward inner support form at least one channel area to receive the forward spikes of said spikes; wherein said rear shoulder and said rear inner support form at least one channel area to receive the rear spikes of said spikes; wherein said sole serves to protect against damage by or to said spikes; and wherein at least one of said inner supports has a raised portion which is elevated above said shoulders.

3. A sports shoe protector comprising a sole and a means for securing said sole to a shoe having spikes; wherein said sole is comprised of a substantially planar base, a forward U-shaped shoulder extending from the forward peripheral portion of said base, a rear U-shaped shoulder extending from the rear peripheral portion of said base, a forward inner support extending from said base and positioned at least partially within the mouth of said forward U-shaped shoulder, and a rear inner support extending from the said base and positioned at least partially within the mouth of said rear U-shaped shoulder; wherein the peripheral shape of said base is sized and dimensioned to accommodate said shoe; wherein said forward shoulder provides peripheral support to the forward portion of said shoe when said sole is secured to said shoe; wherein said rear shoulder provides peripheral support to the rear portion of said shoe when said sole is secured to said shoe; wherein said forward inner support provides support to the forward portion of said shoe when said sole is secured to said shoe; wherein said rear inner support provides support to the rear portion of said shoe when said sole is secured to said shoe; wherein said forward shoulder and said forward inner support form at least one channel area to receive the forward spikes of said spikes; wherein said rear shoulder and said rear inner support form at least one channel area to receive the rear spikes fo said spikes; and wherein said sole serves to protect against damage by or to said spikes; wherein said sole further comprises a bridge extending from said base; and wherein said bridge connects said inner supports.

4. A sports shoe protector comprising a sole and a means for securing said sole to a shoe having spikes; wherein said sole is comprised of a substantially planar base, a forward U-shaped shoulder extending from said base and a forward inner support extending from said base; wherein the peripheral shape of said base is sized and dimensioned to accommodate said shoe; wherein said forward U-shaped shoulder is positioned on the forward peripheral portion of said base to provide peripheral support to the forward portion of said shoe when said sole is secured to said shoe; wherein said forward inner support is positioned on the forward portion of said base at least partially within the mouth of said forward U-shaped shoulder; wherein said forward inner support is positioned to provide support to the forward portion of said shoe when said sole is secured to said shoe; wherein said forward U-shaped shoulder and said forward inner support form at least one channel area positioned to receive the forward spikes of said spikes; wherein said sole serves to protect against damage by or to said spikes; wherein said sole further comprises a rear peripheral U-shaped shoulder extending from said base and a rear inner support extending from said base; wherein said rear U-shaped shoulder is positioned on the rear peripheral portion of said base to provide peripheral support to the rear portion of said shoe when siad sole is secured to said shoe; wherein said rear inner support is positioned on the rear portion of said base at least partially within the mouth of said rear U-shaped shoulder; wherein said rear inner support is positioned to provide support to the rear portion of said shoe when said sole is secured to said shoe; wherein said rear U-shaped shoulder and said rear inner support form at least one channel area positioned to receive the rear spikes of said spikes; wherein said sole is stretchable; wherein said forward U-shaped shoulder and said rear U-shaped shoulder are connected by at least one bridge; and wherein said at least one bridge is substantially thinner than said shoulders to facilitate stretching of said sole.

5. A sports shoe protector comprising a sole and a means for securing said sole to a shoe having spikes; wherein said sole is comprised of a substantially planar base, a forward U-shaped shoulder extending from said base and a forward inner support extending from said base and a forward inner support extending from said base; wherein the peripheral shape of said base is sized and dimensioned to accommodate said shoe; wherein said forward U-shaped shoulder is positioned on the forward peripheral portion of said base to provide peripheral support to the forward portion of said shoe when said sole is secured to said shoe; wherein said forward inner support is positioned on the forward portion of said base at least partially within the mouth of said forward U-shaped shoulder; wherein said forward inner support is positioned to provide support to the forward portion of said shoe when said sole is secured to said shoe; wherein said forward U-shaped shoulder and said forward inner support form at least one channel area positioned to receive the forward spikes of said spikes; and wherein said sole serves to protect against damage by or to said spikes; wherein said sole further comprises a rear peripheral U-shaped shoulder extending from said base and a rear inner support extending from said base; wherein said rear U-shaped shoulder is positioned on the rear peripheral portion of said base to provide peripheral support to the rear portion of said shoe when said sole is secured to said shoe; wherein said rear inner support is positioned on the rear portion of said base at least partially within the mouth of said rear U-shaped shoulder; wherein said rear inner support is positioned to provide support to the rear portion of said shoe when said sole is secured to said shoe; wherein said rear U-shaped shoulder and said rear inner support form at least one channel area positioned to receive the rear spikes of said spikes; and wherein said forward inner support includes a raised portion which is elevated above said U-shaped shoulder.

6. A sports shoe protector in accordance with claim 5 wherein said means for securing said sole to said shoe is a flexible material which is connected to said sole and is shaped and adapted to receive and fit around said shoe.

* * * * *